US009413095B2

(12) United States Patent
Miyazaki et al.

(10) Patent No.: US 9,413,095 B2
(45) Date of Patent: Aug. 9, 2016

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Katsushi Miyazaki, Mie (JP); Hiroyoshi Maesoba, Mie (JP); Ryoya Okamoto, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/782,369

(22) PCT Filed: Mar. 20, 2014

(86) PCT No.: PCT/JP2014/057738

§ 371 (c)(1),
(2) Date: Oct. 5, 2015

(87) PCT Pub. No.: WO2014/162891

PCT Pub. Date: Oct. 9, 2014

(65) Prior Publication Data

US 2016/0043493 A1 Feb. 11, 2016

(30) Foreign Application Priority Data

Apr. 5, 2013 (JP) ..... 2013-079439

(51) Int. Cl.
*H01R 13/42* (2006.01)
*H01R 13/514* (2006.01)
*H01R 13/518* (2006.01)

(52) U.S. Cl.
CPC ..... *H01R 13/42* (2013.01); *H01R 13/514* (2013.01); *H01R 13/518* (2013.01)

(58) Field of Classification Search
USPC ..... 439/594, 717, 701
See application file for complete search history.

(56) References Cited

U.S. PATENT DOCUMENTS 5,122,077 A * 6/1992 Maejima ..... H01R 13/514 439/398
5,997,362 A * 12/1999 Hatagishi ..... H01R 13/42 439/701

(Continued)

FOREIGN PATENT DOCUMENTS

DE 29812500 U1 9/1998
EP 1020959 A2 7/2000

(Continued)

OTHER PUBLICATIONS

European Search Report Dated Jan. 28, 2016.

(Continued)

*Primary Examiner* — Tho D Ta
(74) *Attorney, Agent, or Firm* — Gerald E. Hespos; Michael J. Porco; Matthew T. Hespos

(57) ABSTRACT

A connector (20) to be connected to a device-side connector (10A) has terminals (21) to be connected to end parts of wires W, and terminal accommodating members (22A to 22D) accommodate the terminals (21). A holding member (41) includes two pair of side walls (42, 43) facing each other and two coupling walls (47, 47) connecting ends of the side walls (42, 43) in an extending direction and are configured to hold the terminal accommodating members (22A to 22D) side by side in a direction along the extending direction of the side walls (42, 43) between the side walls (42, 43). Each terminal accommodating member (22A to 22D) includes two supports (38, 38) projecting toward the respective side walls (42, 43) and supported on the respective side walls (42, 43).

10 Claims, 20 Drawing Sheets

(56) References Cited

U.S. PATENT DOCUMENTS 6,007,386 A * 12/1999 Okabe ..... H01R 13/42 439/701
2014/0024262 A1 1/2014 Okamoto et al.

FOREIGN PATENT DOCUMENTS

GB 990416 A 4/1965
JP 2001155813 A 6/2001
JP 2009054472 A 3/2009
JP 2010-67458 3/2010
JP 2012-142221 7/2012
JP 2012-226882 11/2012
WO 2012144364 A1 10/2012

OTHER PUBLICATIONS

International Search Report.

* cited by examiner

CONNECTOR

BACKGROUND

1. Field of the Invention

The present invention relates to a connector.

2. Description of the Related Art

Conventionally, a connector is known in which a plurality of terminals mounted on end parts of wires are accommodated side by side and which is fitted and connected to a device-side connector provided on a device side.

In some connectors of this type, a plurality of terminal accommodating members for accommodating each of a plurality of terminals are movably held in a holding member, whereby a tolerance of the device-side connector is absorbed by movements of the terminal accommodating members and two connectors can be connected.

A connector in which a plurality of cavities for accommodating each of a plurality of terminals are accommodated in a holder configured separately from the cavities is described in Japanese Unexamined Patent Publication No. 2012-226882.

In the holder of this connector, adjacent cavities are partitioned by walls of accommodation chambers and the plurality of cavities inserted into the accommodation chambers of the holder are held between the walls of the accommodation chambers for each cavity.

Since walls or the like need to be provided between adjacent cavities to hold the cavities in the accommodation chambers in the above configuration, there has been a problem that the configuration of the connector tends to be complicated.

The present invention was completed based on the above situation and aims to simplify the configuration of a connector.

SUMMARY

The present invention is directed to a connector to be connected to a mating connector provided on a device side, including a plurality of terminals to be connected to end parts of wires, a plurality of terminal accommodating members configured to accommodate the plurality of terminals, and a holding member including a pair of side wall portions facing each other and a pair of coupling wall portions connecting end sides of the pair of side wall portions in an extending direction and configured to hold the plurality of terminal accommodating members side by side in a direction along the extending direction of the side wall portions between the pair of side wall portions, each terminal accommodating member including a pair of supporting portions projecting toward the respective side wall portions and supported on the respective side wall portions.

With this arrangement, the terminal accommodating member is supported on the respective side wall portions via the pair of supporting portions. Thus, the holding member can hold the terminal accommodating member via the pair of supporting portions even without partitioning the holding member by walls of accommodation chambers. Therefore, the configuration of the connector can be simplified.

Further, since the terminal accommodating member is held by supporting the pair of supporting portions on the side wall portions even if this arrangement is adopted, displacements of the pair of supporting portions can be easily allowed according to a tolerance when the connector is connected to the mating connector.

The following configurations are preferable as embodiments of the above configuration.

The pair of supporting portions coaxially project.

With this arrangement, the displacement of the terminal accommodating member during the connection to the mating connector is enabled by the rotation of the terminal accommodating member about the axes of the supporting portions.

The terminal accommodating member is assembled by being inserted between the pair of side wall portions, and the pair of supporting portions are arranged on a rear end side of the terminal accommodating member in an inserting direction.

With this arrangement, a configuration for supporting the pair of supporting portions on the pair of side wall portions can be simplified.

The mating connector is configured by stacking a plurality of split connector portions, the split connector portion includes a mating terminal to be connected to the terminal and a partition wall partitioning the mating terminal from outside, the partition wall of one of the plurality of split connector portions is formed into a rectangular tube surrounding the mating terminal on four sides and the partition walls of the other partition walls are formed into a U shape with one open side surrounding the mating terminal on three sides, and the mating connector is configured by stacking the plurality of split connector portions such that the one open side of the partition wall in the split connector portion is covered by the partition wall of the adjacent split connector portion.

With this arrangement, the mating connector configured by stacking the plurality of split connector portions can be miniaturized by reducing the partition walls for insulating the mating terminals from outside. Thus, the connector to be connected to the mating connector can also be miniaturized.

The terminal accommodating member is assembled by being inserted between the pair of side wall portions and includes a guide portion for guiding the terminal accommodating member in the inserting direction by being engaged with the other terminal accommodating member adjacently located in an arrangement direction of the terminal accommodating members and at least one of the pair of side wall portions.

With this arrangement, the insertion of the terminal accommodating member into the holding member can be facilitated.

Each of the plurality of terminal accommodating members includes a locking portion configured to lock the other terminal accommodating member adjacently located in an arrangement direction of the terminal accommodating members.

With this arrangement, adjacent terminal accommodating members can be held in position utilizing the configurations of the terminal accommodating members.

Further, since the locking portion is locked to the other terminal accommodating member in a direction different from the pair of supporting portions, it can be held in a stable posture.

The mating connector is provided on a device unit configured by stacking a plurality of flat devices.

For the connector to be connected to the mating connector in which a tolerance is easily generated between the terminals since the plurality of flat devices are stacked, the tolerance of the mating connector can be absorbed by providing the terminal accommodating members separately from the holding member. Since the terminal accommodating member is supported on the respective side wall portions via the pair of supporting portions in such a configuration capable of absorbing the tolerance, the configuration of the connector can be simplified.

According to the present invention, it is possible to simplify the configuration of a connector.

DETAILED DESCRIPTION

One embodiment of the present invention is described with reference to FIGS. 1 to 20.

Figure 8:
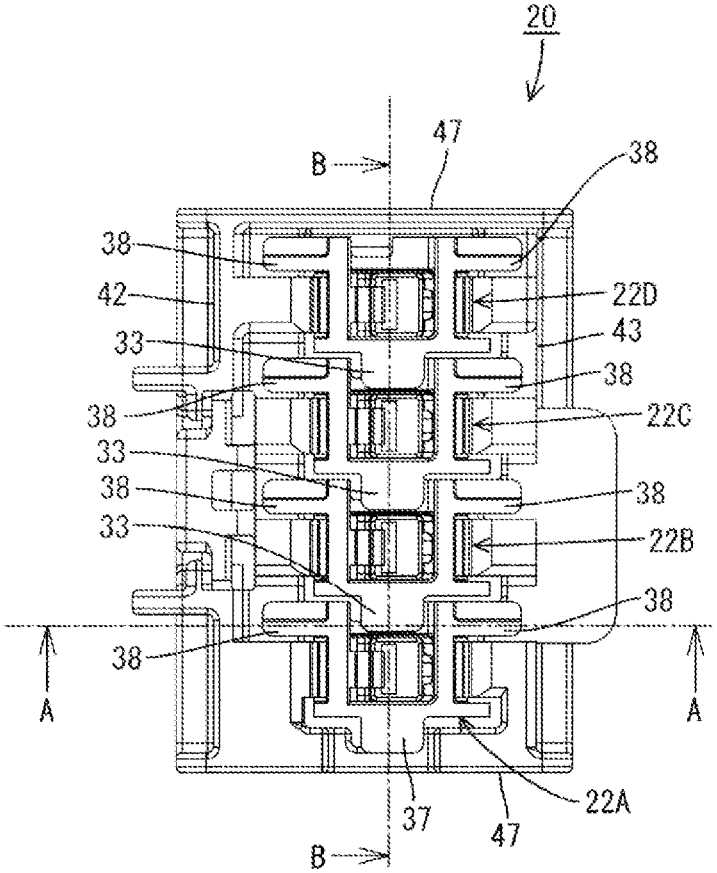
FIG. 8 is a plan view showing the connector.
Figure 9:
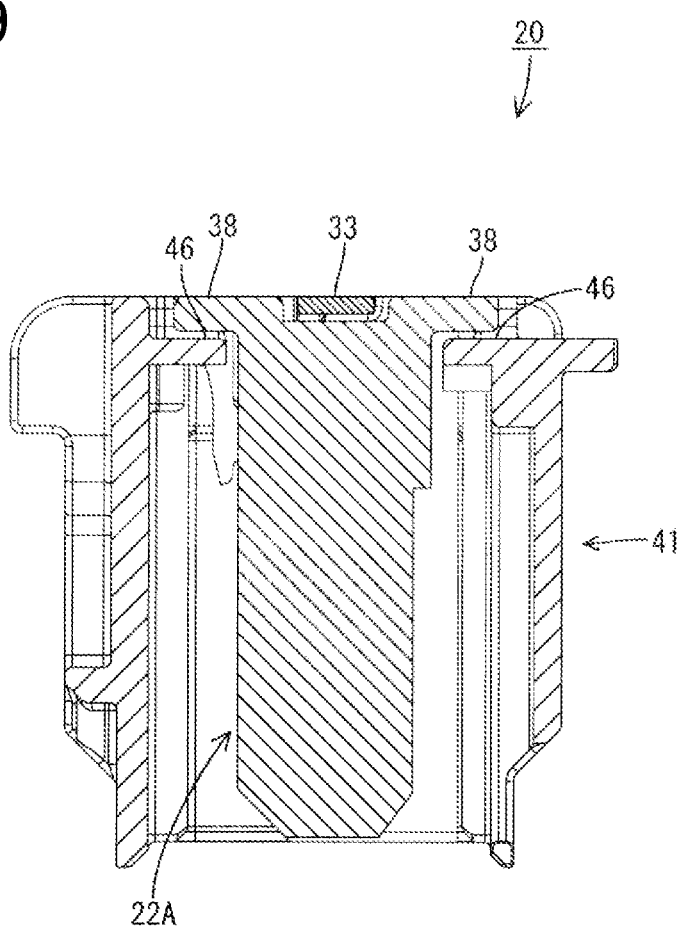
FIG. 9 is a section along A-A of FIG. 8.

A connector 20 in this embodiment is to be connected to a device-side connector 10A (example of a "mating connector") provided on the side of devices 11A to 11D. In the following description, lower and upper sides of FIG. 8 are referred to as front and rear sides concerning a front-back direction and a vertical direction is based on that of FIG. 9.

Figure 2:
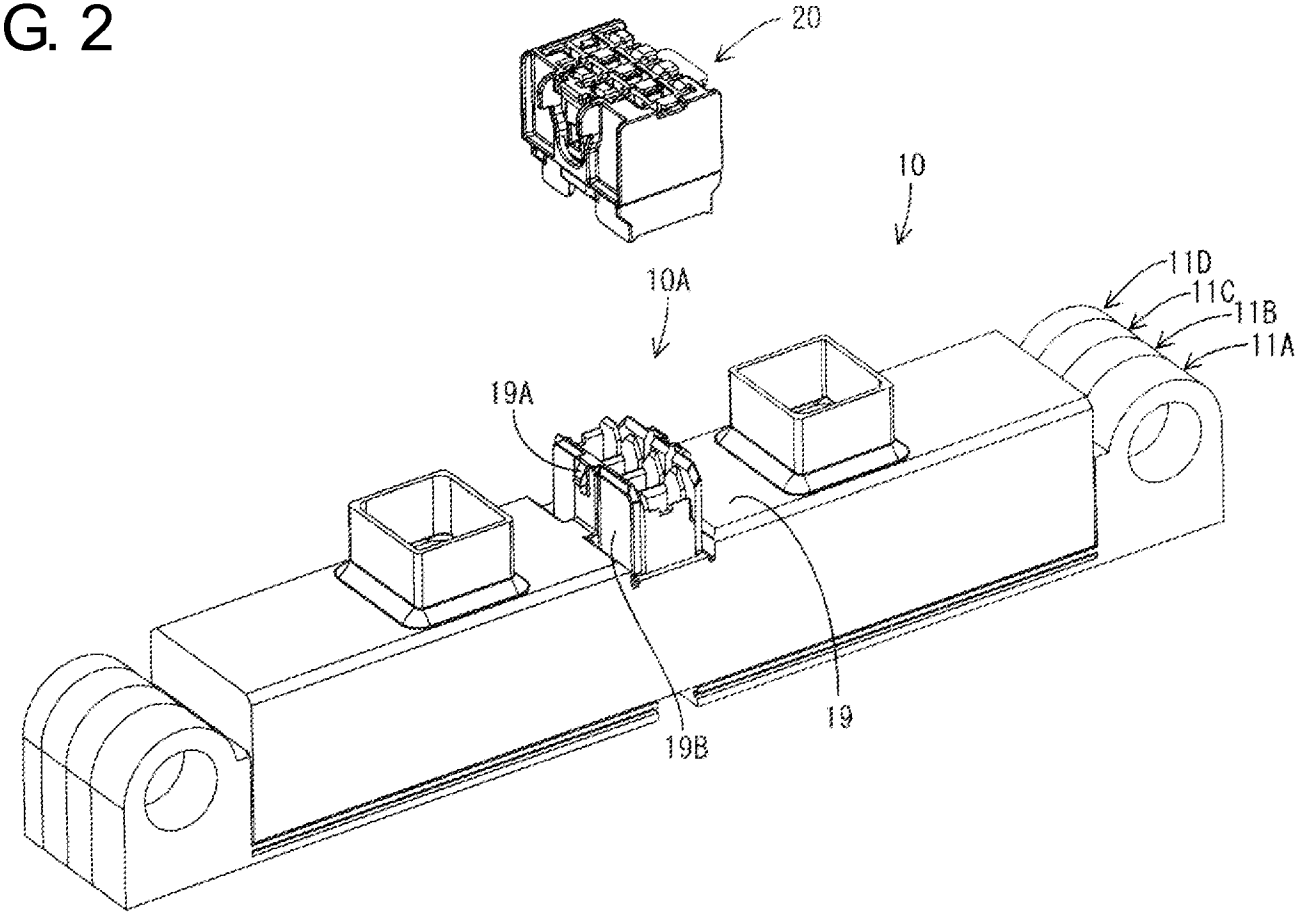
FIG. 2 is a perspective view showing a state where the connector in a connected state is detached from the device-side connector.
Figure 3:
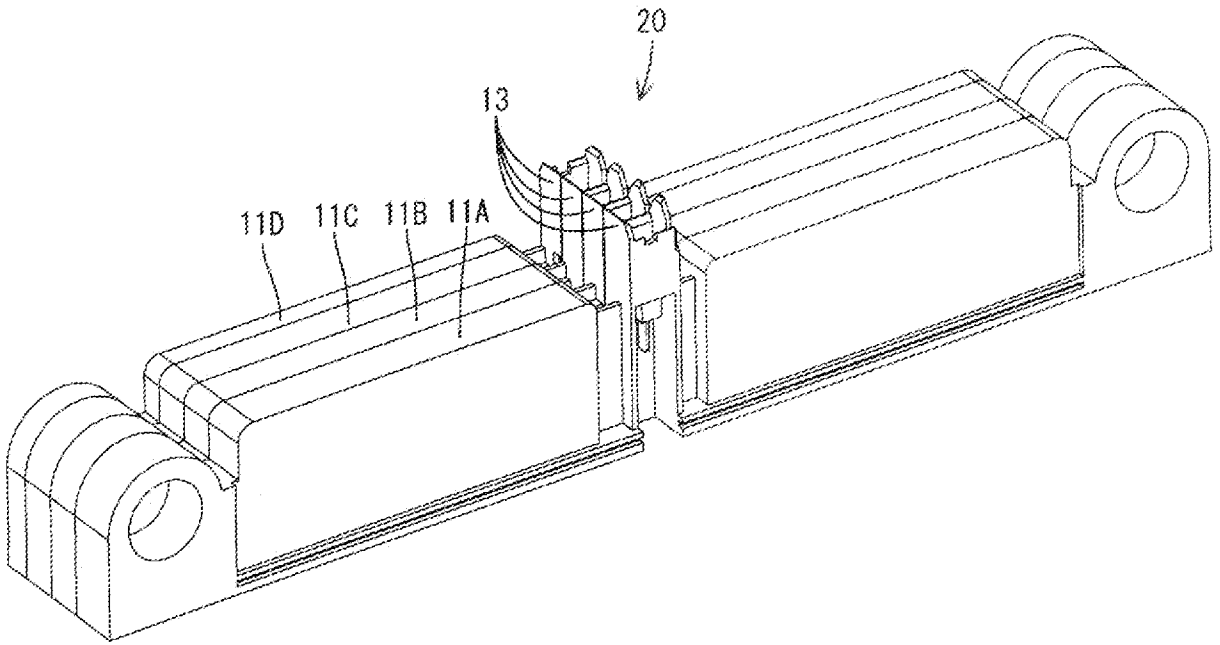
FIG. 3 is a perspective view showing a state where a case of a device unit is removed.
Figure 4:
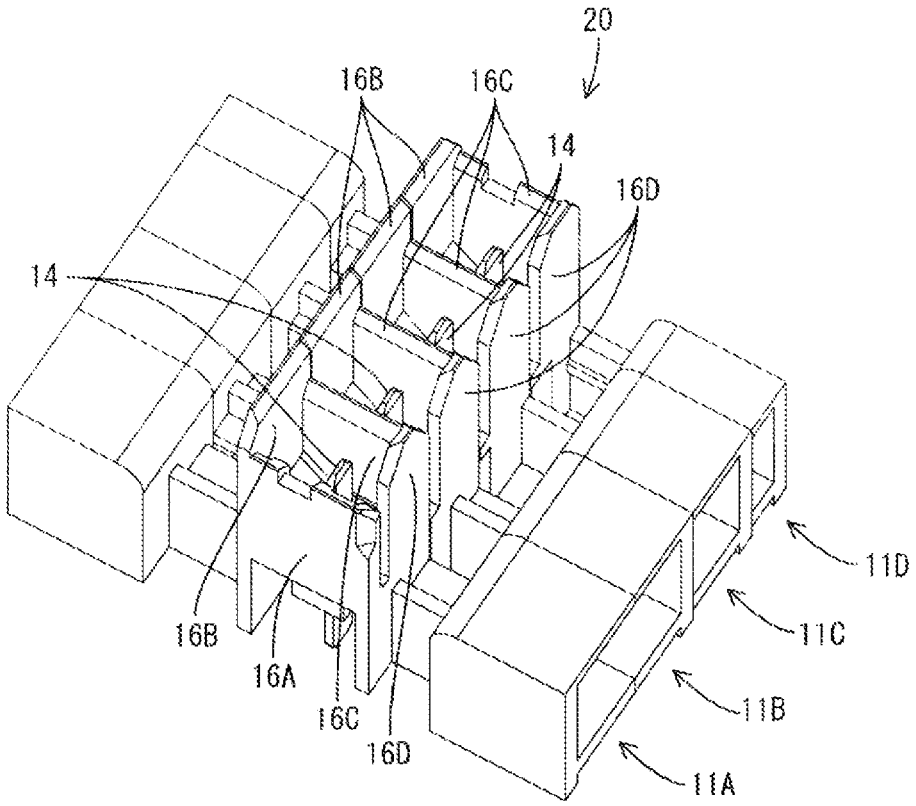
FIG. 4 is a perspective view showing the device-side connector.
Figure 5:
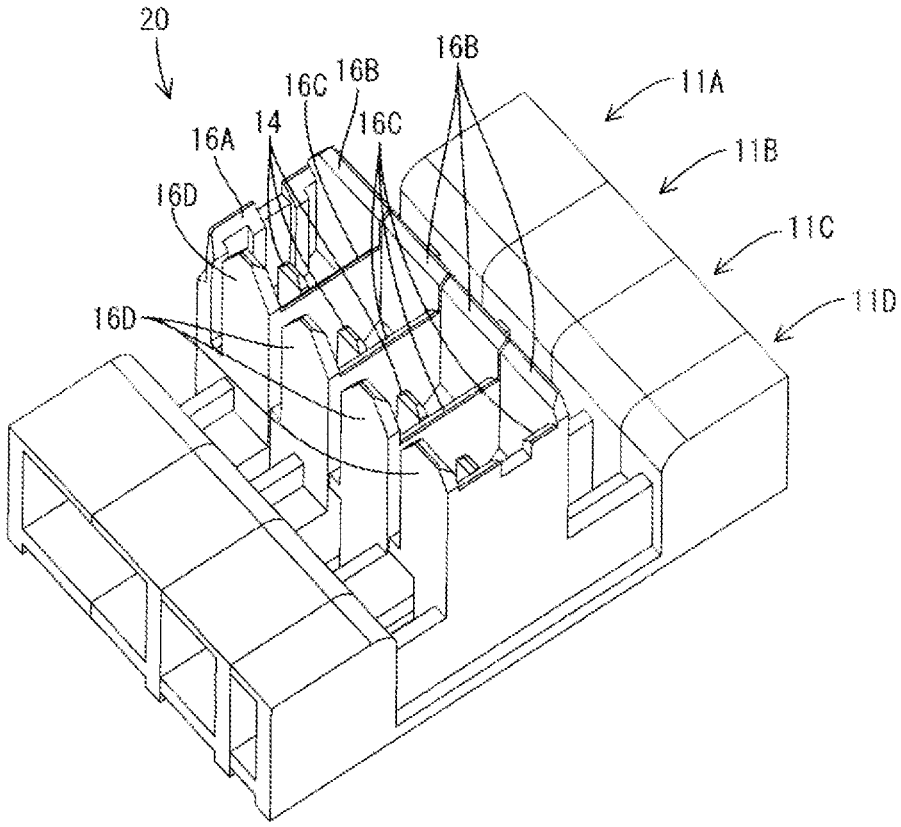
FIG. 5 is a perspective view showing the device-side connector viewed in a direction different from FIG. 4.

As shown in FIG. 2, the device-side connector 10A is a connector provided on a device unit 10 including flat devices 11A to 11D such as batteries and substrates.

(Device Unit 10)

Figure 7:
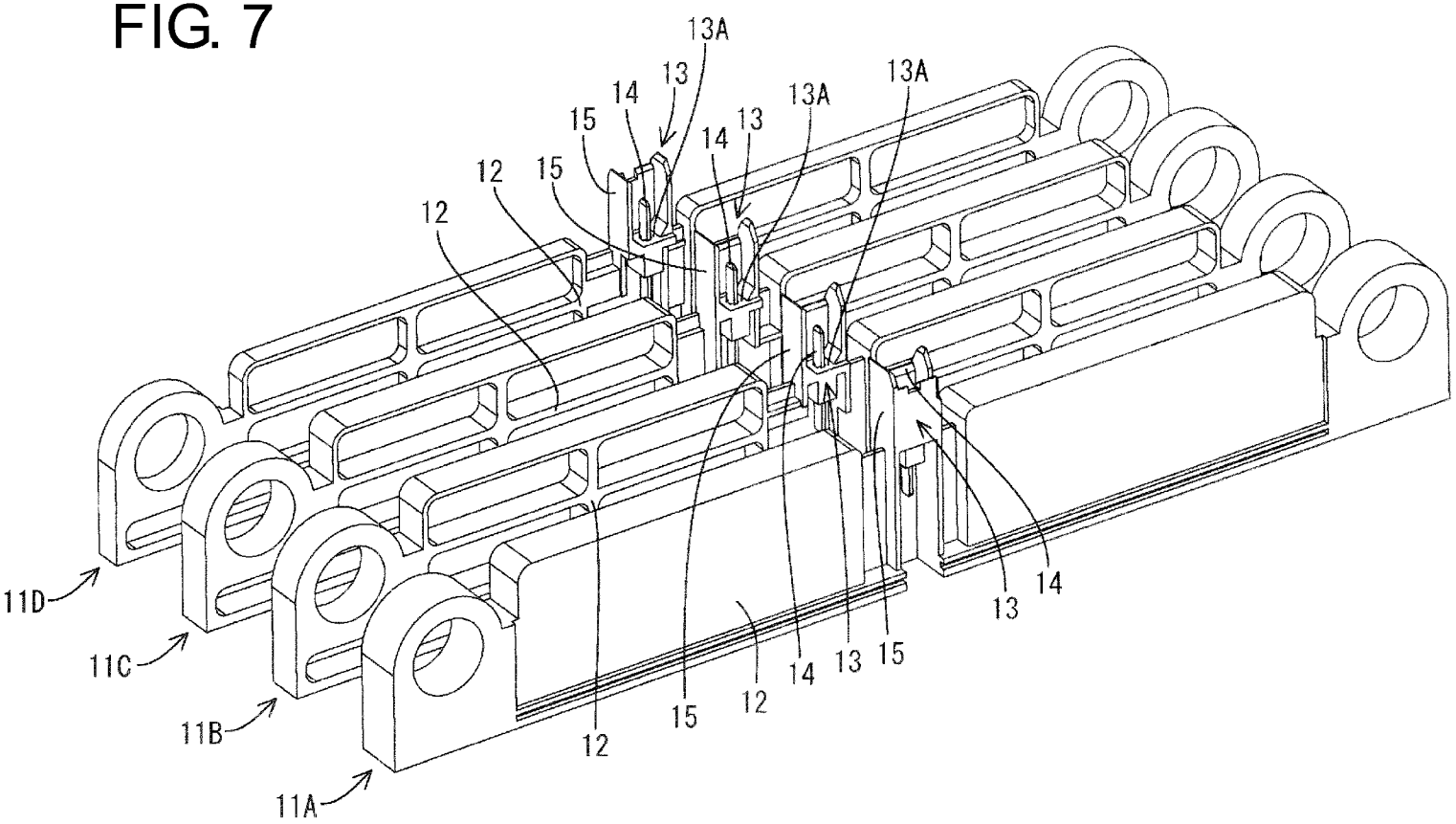
FIG. 7 is a perspective view showing a state where a plurality of devices of the device unit are separated.

As shown in FIG. 7, the device unit 10 is configured by stacking a plurality of (four in this embodiment) devices 11A to 11D.

The device 11A to 11D includes a flat main body 12 having a flat shape and a split connector portion 13 projecting from an end surface of the flat main body 12 and formed by dividing the device-side connector 10A into four.

The split connector portion 13 includes a tab-like male terminal 14, a partition wall 15 partitioning the male terminal 14 from outside and a back wall 13A closing the lower end of the partition wall 15.

The partition wall 15 stands vertically upward from an edge part of the back wall 13A having an upper surface extending along the upper end surface of the flat main body 12.

Figure 6:
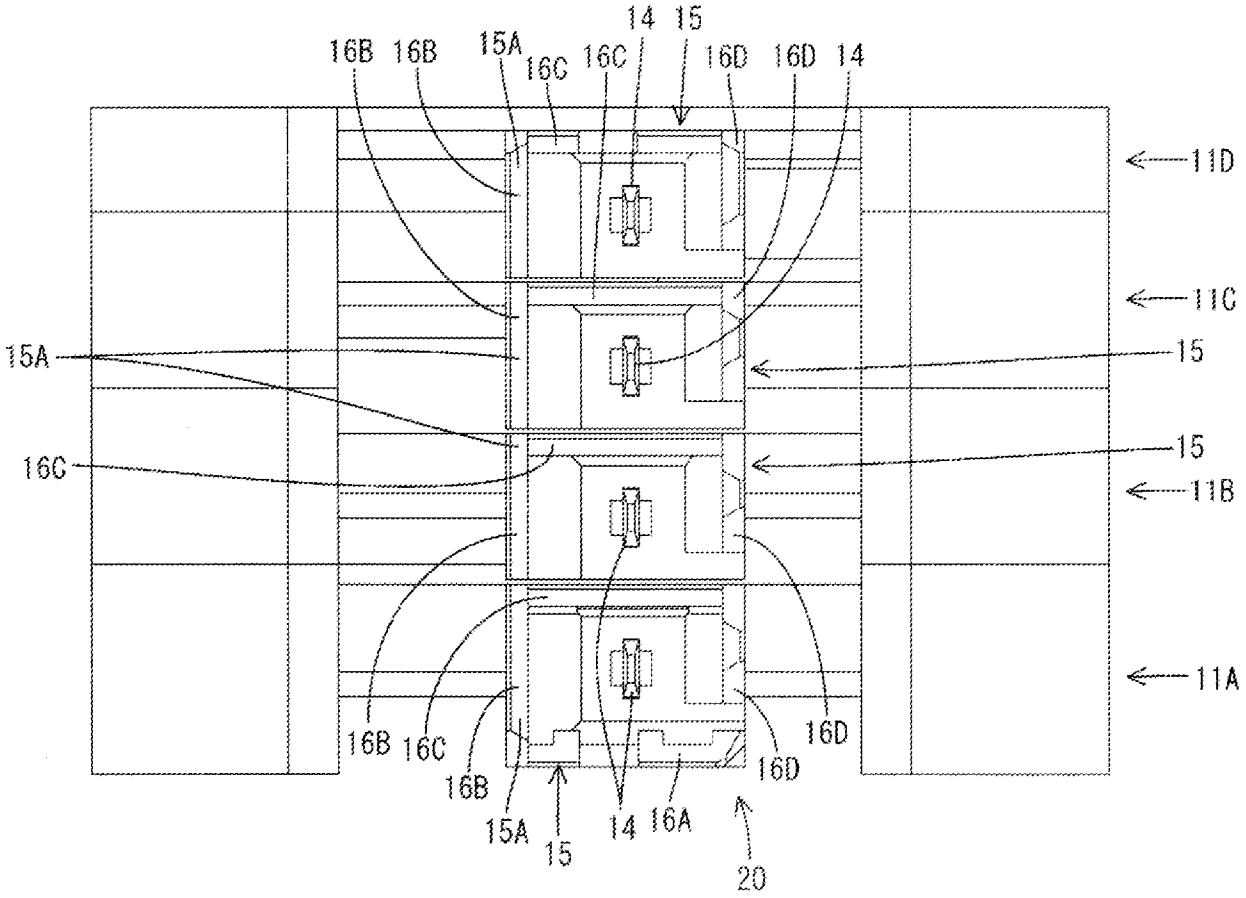
FIG. 6 is a plan view showing the device-side connector.

The partition wall 15 of the device 11A on a front end (one end in an arrangement direction) out of the devices 11A to 11D is formed into a rectangular tube surrounding the male terminal 14 on four sides as shown in FIG. 6, and a front wall 16A and a rear wall 16C facing each other are coupled by a pair of side walls 16B, 16D.

The partition wall 15 of the device 11B to 11D other than the one on the front end is formed into a substantially U shape open on one side and does not include the front wall 16A, but includes the other rear wall 16C and pair of side walls 16B, 16D.

This causes the rear wall 16C of each device 11A to 11C to close a space open on front end parts of the side walls 16B, 16D (parts where the front wall 16A is not provided) in the partition wall 15 of the device 11B to 11D adjacent on the rear side when the devices 11A to 11D are stacked. This causes all the male terminals 14 to be surrounded on four sides by the partition walls 15 and insulated from outside by the partition walls 15 when the plurality of devices 11A to 11D are stacked.

An inner surface side of an upper end part of the partition wall 15 is obliquely cut to form a guiding surface 15A.

A tip part of a terminal accommodating member 22A to 22D comes into contact with the guiding surface 15A when the connector 20 and the device-side connector 10A are connected, whereby the tip part of the terminal accommodating member 22A to 22D is displaced and guided into the inside of the partition wall 15.

The plurality of devices 11A to 11D are stacked in such a direction that flat surfaces overlap, and the plurality of split connector portions 13 are collected to form the device-side connector 10A in which a plurality of (four in this embodiment) male terminals 14 are held in a housing. This device-side connector 10A projects in a direction extending along the flat surfaces from end surfaces of the devices 11A to 11D (device unit 10).

As shown in FIG. 2, the device unit 10 is covered with a case 19.

This case 19 includes a receptacle 19B forming an outer peripheral wall of the device-side connector 10A, and lock protrusions 19A to be locked when the connector 20 is connected are formed on outer surfaces of the receptacle 19B.

Figure 1:
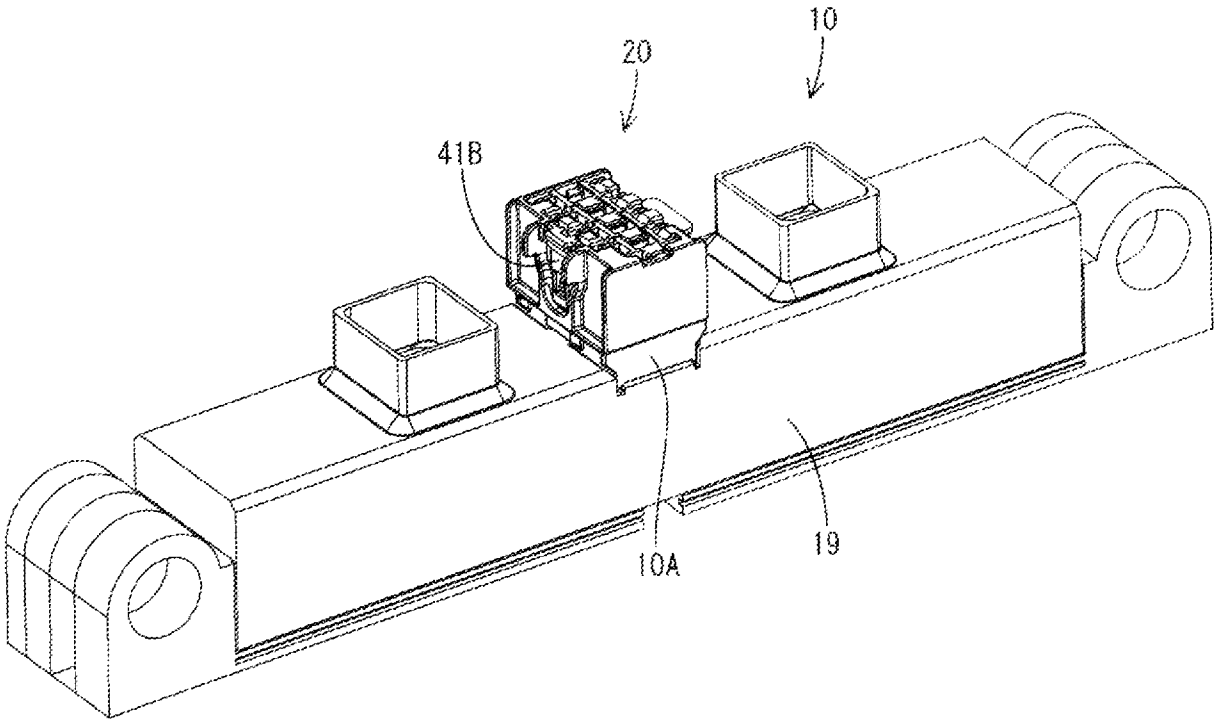
FIG. 1 is a perspective view showing a state where a connector of an embodiment is connected to a device-side connector.

When the connector 20 is connected to the device-side connector 10A, the lock protrusions 19A are fitted into and locked to lock holes of lock receiving portions 41B on the side of the connector 20 as shown in FIG. 1, whereby the two connectors 10A, 20 are locked in a connected state.

(Connector 20)

Figure 10:
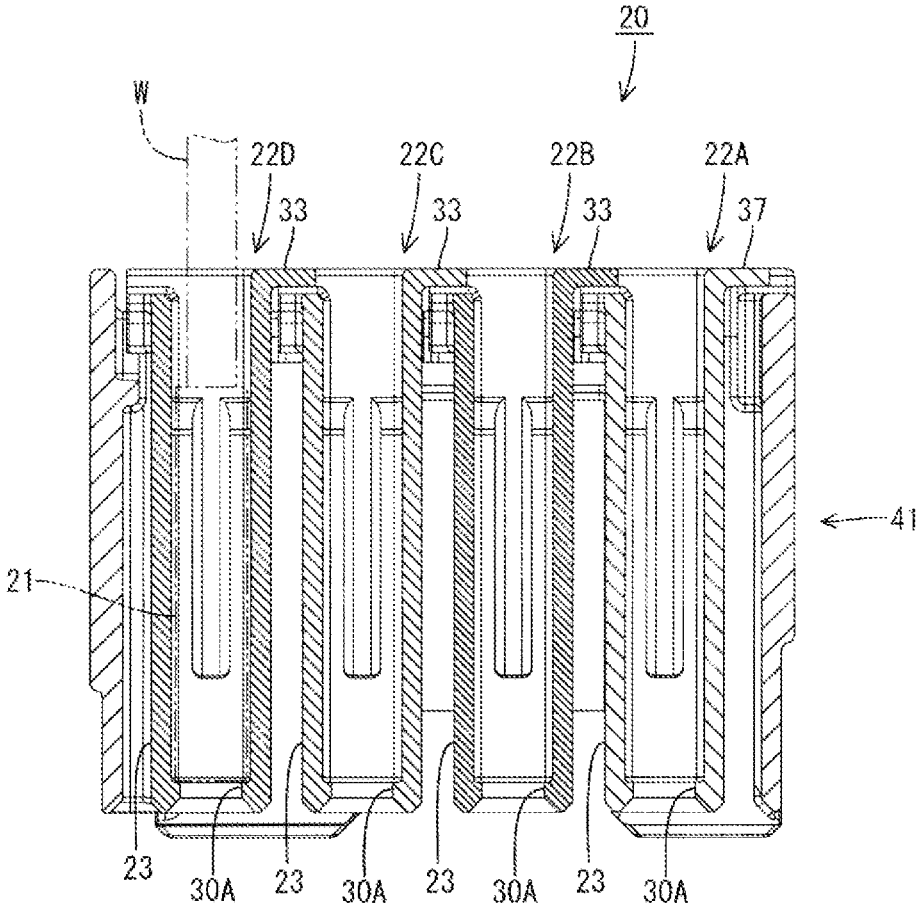
FIG. 10 is a section along B-B of FIG. 8.
Figure 11:
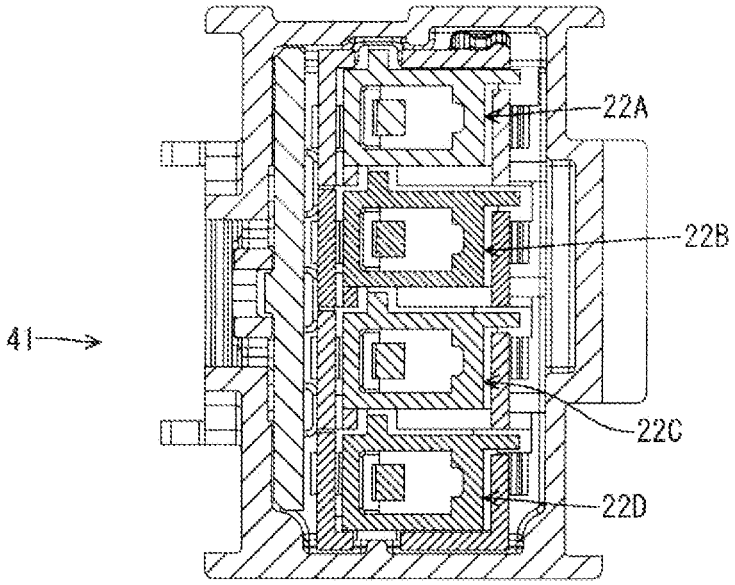
FIG. 11 is a plan view in section of the connector.

The connector 20 is a connector to be connected to end parts of wires W such as a voltage detection line and a power line and includes, as shown in FIG. 10, a plurality of (four in this embodiment) terminals 21 to be connected to the end parts of the wires W (only one terminal is schematically shown in FIG. 10 and the other terminals are not shown), a plurality of (four in this embodiment) terminal accommodating members 22A to 22D for individually accommodating the plurality of terminals 21, and one holding member 41 configured such that the plurality of terminal accommodating members 22A to 22D are inserted thereinto to be held side by side.

The terminal 21 is a female terminal and includes a box-like terminal connecting portion into which the male terminal 14 is to be inserted for connection, and a wire connecting portion to which the wire W is to be connected.

(Terminal Accommodating Members 22A to 22D)

Figure 12:
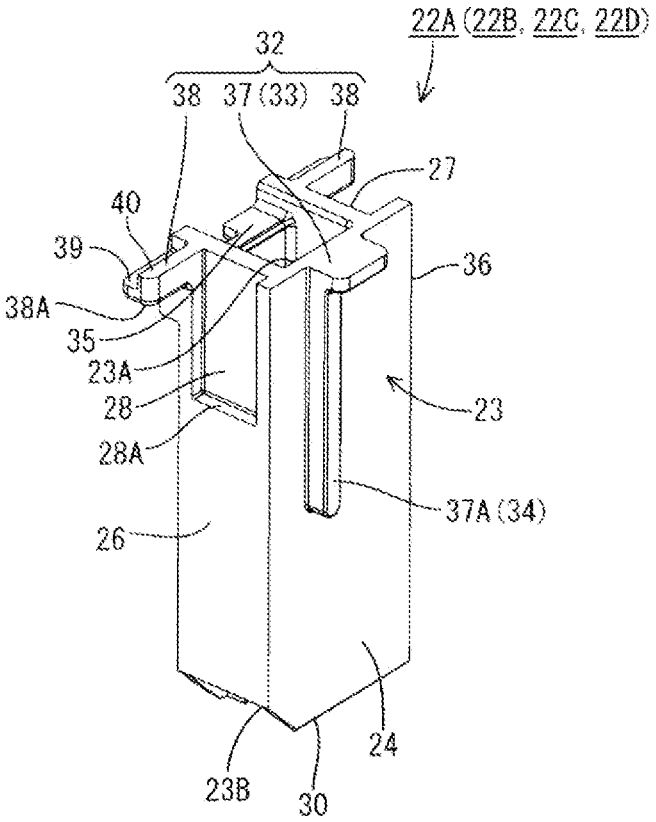
FIG. 12 is a perspective view showing a terminal accommodating member.
Figure 13:
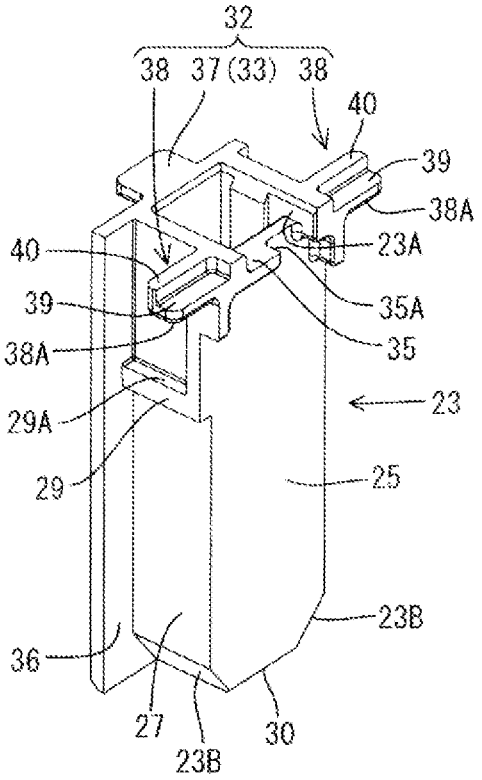
FIG. 13 is a perspective view showing the terminal accommodating member viewed in a direction different from FIG. 12.
Figure 14:
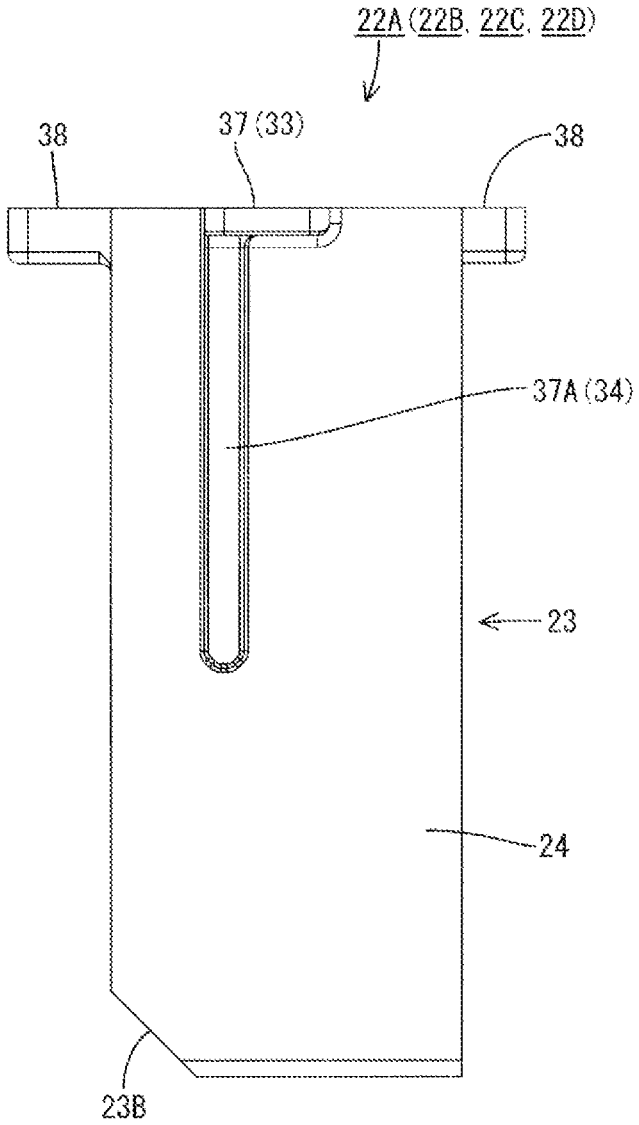
FIG. 14 is a front view showing the terminal accommodating member.
Figure 15:
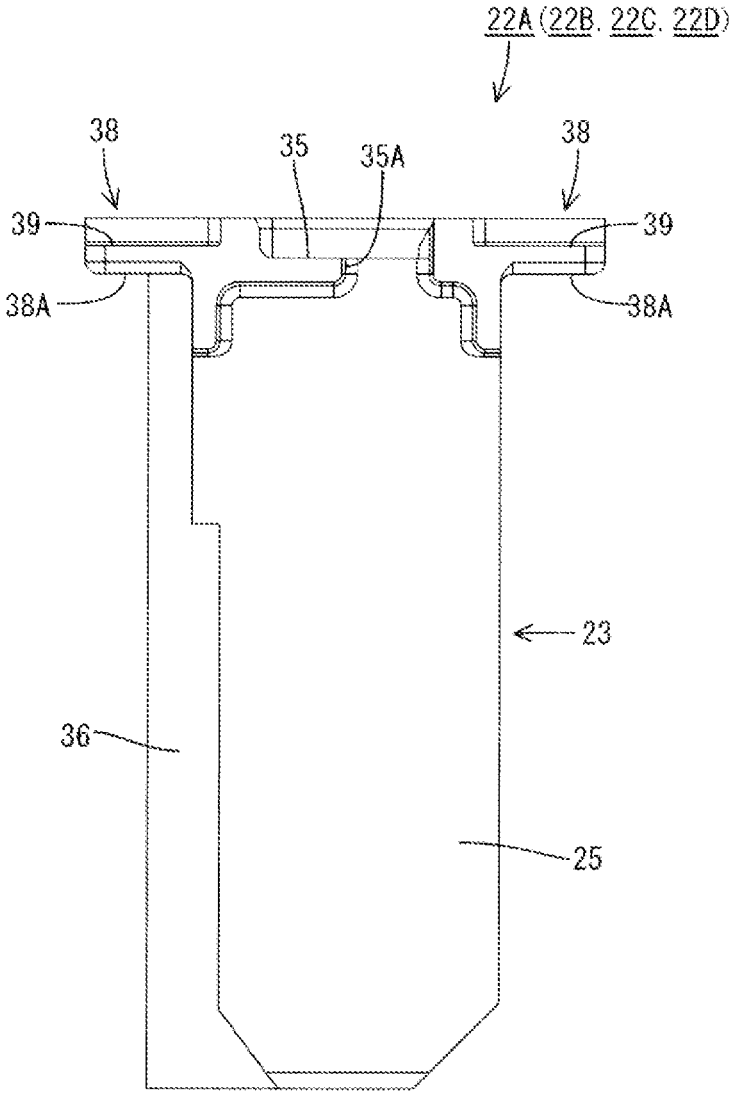
FIG. 15 is a rear view showing the terminal accommodating member.

The plurality of terminal accommodating members 22A to 22D are all made of synthetic resin and identically shaped and include, as shown in FIGS. 12 and 13, a tubular portion 23 in the form of a rectangular tube into which the terminal 21 is accommodated to be held inside and a plurality of (three in this embodiment) holding portions 32 protruding outward from upper end part of the tubular portion 23.

The tubular portion 23 includes plate-like front wall 24 and rear wall 25 arranged to face each other and a pair of plate-like side walls 26, 27 connecting the front wall 24 and the rear wall 25.

An opening 23A through which the terminal 21 is insertable is formed on the upper end of the tubular portion 23.

On a lower end part of the tubular portion 23, the both side walls 26, 27 are obliquely cut to form cut portions 23B.

The side walls 26, 27 of the tubular portion 23 are respectively formed with stepped retaining portions 28A, 29A.

One retaining portion 28A is formed by providing a thinned portion 28 by cutting the outer surface of one side wall 26. The other retaining portion 29A is formed by providing an elongated projection 29 extending in the front-back direction on the outer surface of the other side wall 27.

The holding portions 32 are formed to be flush with the upper end surface of the tubular portion 23 and protrude outward.

The holding portions 32 of the terminal accommodating member 22A (terminal accommodating member located on an end part in an arrangement direction where a locking portion 33 is locked) includes a holding member locking portion 37 to be locked to the holding member 41 by projecting forward from the upper end part of the tubular portion 23 and a pair of supporting portions 38, 38 supported on side wall portions 42, 43 of the holding member 41 by projecting to left and right from the upper end part of the tubular portion 23.

The holding portions 32 of the terminal accommodating member 22B to 22D includes the locking portion 33 to be locked to the terminal accommodating member 22A to 22C by projecting forward from the upper end part of the tubular portion 23 and a pair of supporting portions 38, 38 supported on the side wall portions 42, 43 of the holding member 41 projecting to left and right from the upper end part of the tubular portion 23.

The holding member locking portion 37 and the locking portions 33 are in the form of rectangular plates long in a lateral direction and provided in widthwise middle parts of the upper end parts of the tubular portions 23.

The holding member locking portion 37 is locked to the holding member 41 to have a downward (inserting direction) movement regulated when the terminal accommodating member 22A is inserted to a proper position into the holding member 41.

Below the holding member locking portion 37, an end-part guide protrusion 37A extends downward from one end part of the holding member locking portion 37.

The locking portion 33 is locked to the other terminal accommodating member 22A to 22C located before (adjacent in the arrangement direction) the terminal accommodating member 22B to 22D to regulate a downward (inserting direction) movement of the terminal accommodating member 22B to 22D when the terminal accommodating member 22B to 22D is inserted to a proper position into the holding member 41.

Below the locking portion 33, a first guide protrusion 34 (example of a "guide portion") extends downward from one end part of the locking portion 33.

The upper end of the rear wall 25 is recessed to provide a first placing portion 35 on which the locking portion 33 of the terminal accommodating member 22B to 22D adjacent on the rear side is to be placed.

The first placing portion 35 is recessed by cutting the upper end part of the tubular portion 23 by as much as a thickness of the locking portion 33 (thickness of the holding member locking portion 37).

A width of the first placing portion 35 is set to have predetermined clearances between the first placing portion 35 and opposite lateral ends of the locking portion 33 when the locking portion 33 of the terminal accommodating member 22B to 22D on the rear side is placed on the first placing portion 35.

The predetermined clearances are set at such dimensions that the terminal accommodating members 22A to 22D are permitted to be laterally displaced according to a dimensional tolerance when the connector 20 is connected to the device-side connector 10A.

The first placing portion 35 is formed with a first guide groove portion 35A into which the first guide protrusion 34 of the terminal accommodating member 22B to 22D is inserted.

The first guide groove portion 35A is formed by cutting one widthwise end part of the first placing portion 35.

On a lateral side of the front wall 24, a plate-like second guide protrusion 36 (example of the "guide portion") continuous and flush with the front surface of the front wall 24 extends laterally to the side wall 27.

The pair of supporting portions 38, 38 are in the form of bars projecting toward opposite lateral sides from the rear end edges of upper end parts of the side walls 26, 27.

The pair of supporting portions 38, 38 are symmetrically shaped with respect to a middle point therebetween and center axes thereof are coaxially arranged.

The supporting portion 38 includes a plate-like portion 39 in the form of a flat plate and a thickened portion 40 connected to and before the plate-like portion 39 to thicken an upper surface side of the plate-like portion 39 in a stepped manner.

A bottom surface 38A of the supporting portion 38 is so formed that a middle part in the front-back direction is a flat surface, and front and rear end parts thereof are cut to be somewhat rounded.

When the terminal accommodating member 22B to 22D is mounted at a proper position in the holding member 41, the upper end surfaces of the locking portion 33 and the supporting portions 38 are flush with the upper end surface of the tubular portion 23 of the terminal accommodating member 22A to 22C on the front side to which these upper end surfaces are locked.

Figure 16:
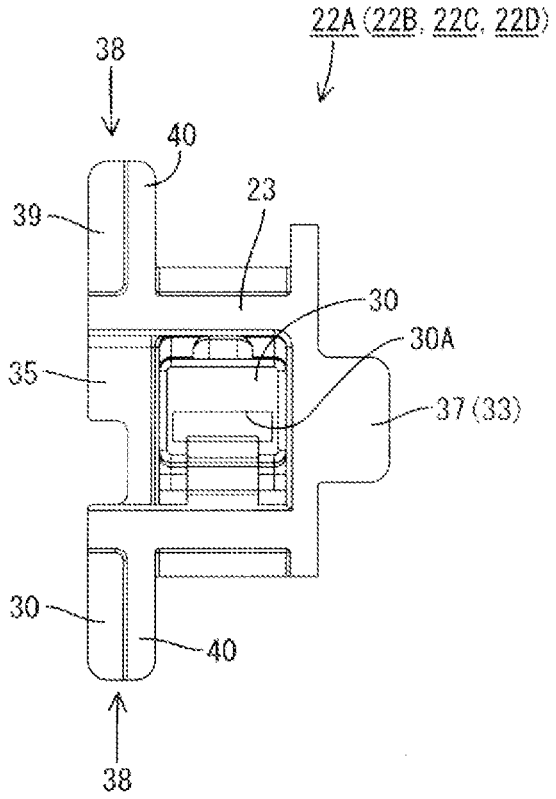
FIG. 16 is a plan view showing the terminal accommodating member.

As shown in FIG. 16, a groove-like terminal insertion hole 30A, into which the male terminal 14 is to be inserted, penetrates through a bottom wall 30 for closing a tip part of the tubular portion 23.

(Holding Member 41)

Figure 17:
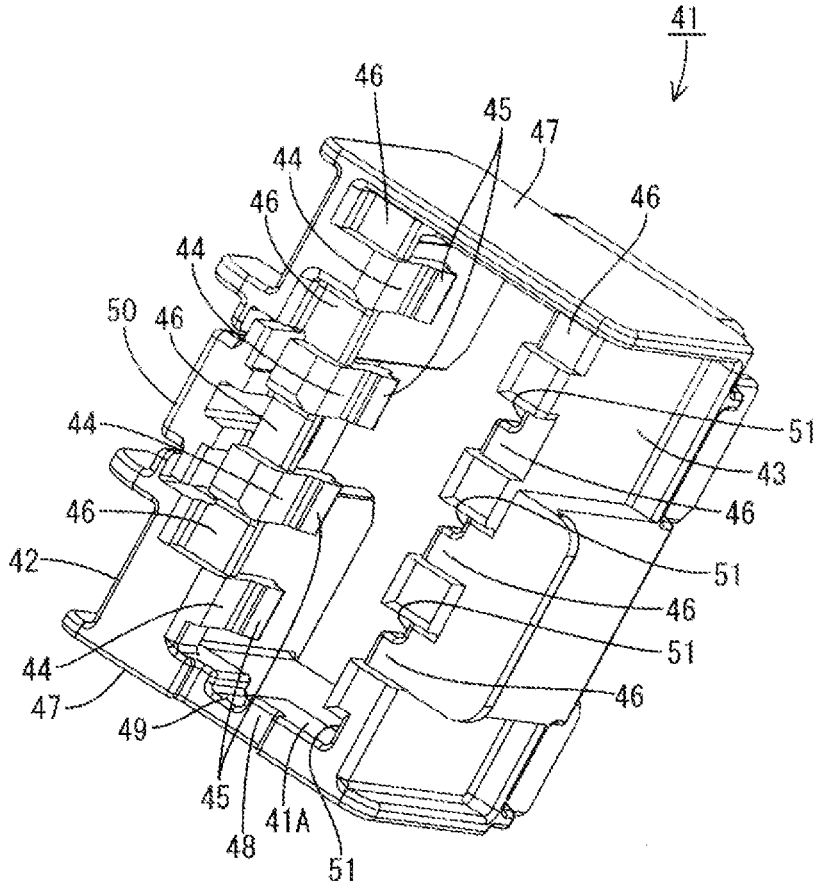
FIG. 17 is a perspective view showing a holding member.
Figure 18:
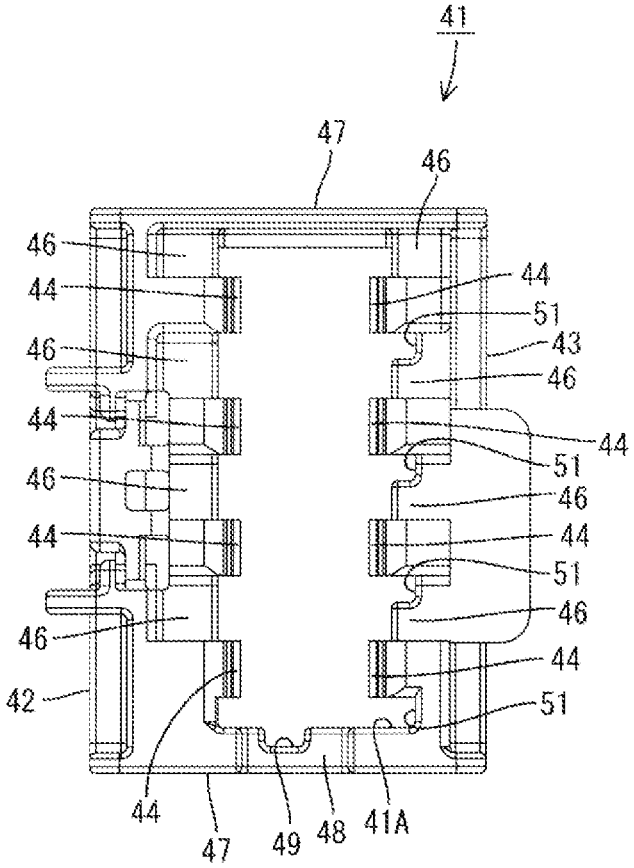
FIG. 18 is a plan view showing the holding member.

As shown in FIG. 17, the holding member 41 is in the form of a frame including an insertion hole 41A into which the terminal accommodating members 22A to 22D are to be inserted and includes a pair of side wall portions 42, 43 arranged to face each other and coupling wall portions 47, 47 coupling between the pair of side wall portions 42, 43.

Four pairs of resilient pieces 44, 44 for sandwiching the respective terminal accommodating members 22A to 22D from opposite left and right sides are provided side by side in the front-back direction on the pair of side walls 42, 43 in correspondence with the respective terminal accommodating members 22A to 22D.

Each resilient piece 44 is cantilevered downwardly with an upper end part of the side wall portion 42, 43 as a base end and a tip side thereof is deflectable and deformable in the lateral direction.

A retaining protrusion 45 to be locked to the retaining portion 28A, 29A of the terminal accommodating member 22A to 22D projects inwardly on the tip part of the resilient piece 44.

A second placing portion 46, on which the supporting portion 38 is to be placed, is recessed at a position behind and adjacent to a base end part of the resilient piece 44.

The second placing portion 46 is positioned on a front side in the inserting direction in the terminal accommodating member 22A to 22D by the contact with the supporting portion 38 to lock the terminal accommodating member 22A to 22D when the terminal accommodating member 22A to 22D is inserted to the proper position in the insertion hole 41A.

A dimension of the second placing portion 46 in the front-back direction is set to have a predetermined clearance between the second placing portion 46 and the supporting portion 38 with the supporting portion 38 placed on the second placing portion 46.

The predetermined clearance is set to have a dimension enabling a displacement of the terminal accommodating member 22A to 22D in the front-back direction according to a dimensional tolerance when the connector 20 is connected to the device-side connector 10A.

Note that since the terminal accommodating members 22A to 22D are adjacent (without being partitioned by walls) in this embodiment as shown in FIG. 8, displacements of the terminal accommodating members 22A to 22D in the front-back direction are limited to a range in the insertion hole 41A where the terminal accommodating members 22A to 22D are movable in the front-back direction (range of clearances in the front-back direction formed by a difference between the length of the insertion hole 41A in the front-back direction and the sum of the lengths of the terminal accommodating members 22A to 22D in the front-back direction). Thus, a range where the supporting portion 38 is movable (displaceable) in the front-back direction in the second placing portion 46 is smaller than the clearance in a state where the supporting portion 38 is placed on the second placing portion 46.

As shown in FIG. 17, the upper end surface of the coupling wall 47 on the front side is recessed to form an accommodating member placing portion 48.

The holding member locking portion 37 of the terminal accommodating member 22A is placed on the bottom surface of the accommodating member placing portion 48.

An end-part guide groove portion 49 into which the end-part guide protrusion 37A of the terminal accommodating member 22A is inserted is formed below the accommodating member placing portion 48.

The side wall portion 43 is formed with second guide groove portions 51 into which the second guide protrusions 36 are inserted to vertically guide the second guide protrusions 36.

The side wall portion 42 is provided with a lock portion 50 for locking the connector 20 in a state connected to the device-side connector 10A.

Next, the assembling of the connector 20 is described.

Figure 20:
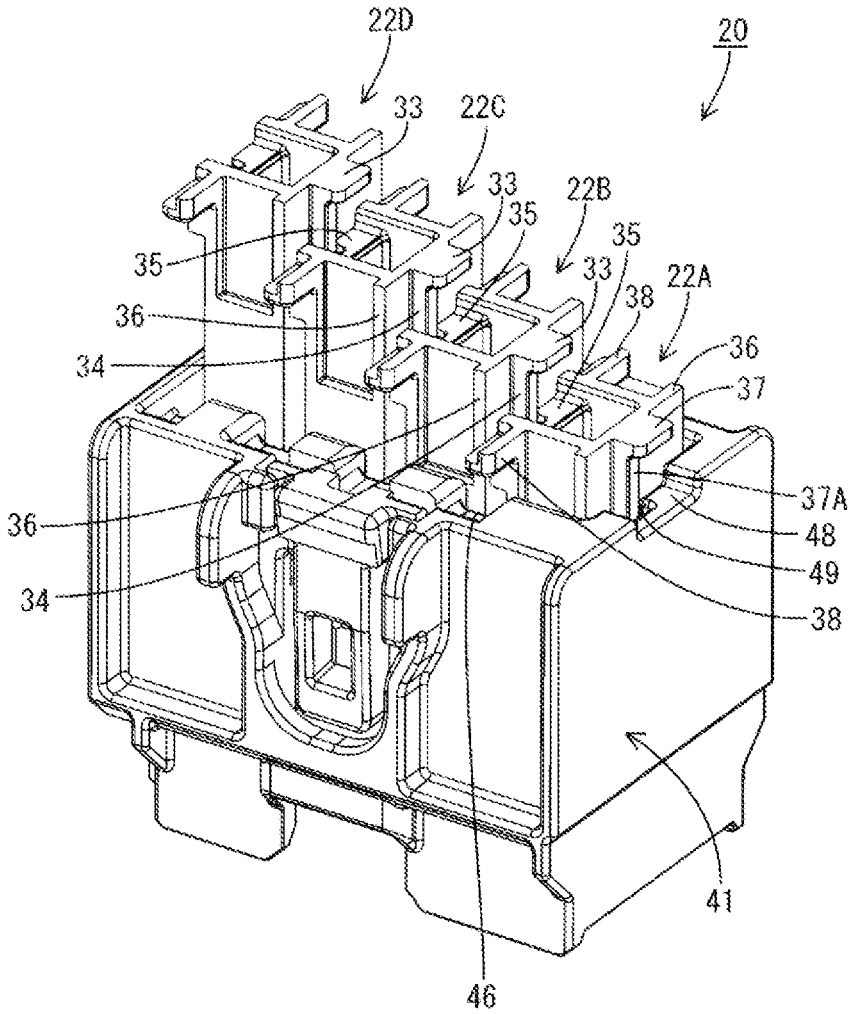
FIG. 20 is a view showing an order of inserting the plurality of terminal accommodating members into the holding member.

Thee terminal accommodating members 22A to 22D are successively fitted into the insertion hole 41A of the holding member 41 from the front side. Since the locking portions 33 of the terminal accommodating members 22B to 22D are arranged on the terminal accommodating members 22A to 22C located in front as shown in FIG. 20, the respective terminal accommodating members 22A to 22D need to be successively inserted from the front side of the holding member 41.

The terminal accommodating member 22A is guided in the inserting direction by inserting the end-part guide protrusion 37A and the second guide protrusion 36 into the end-part guide groove portion 49 and the second guide groove portion 51 of the holding member 41.

When the terminal accommodating member 22A is inserted to the proper position into the holding member 41, the holding member locking portion 37 is locked to the accommodating member placing portion 48 of the holding member 41 and the pair of supporting portions 38, 38 are locked to the second placing portions 46, 46 to regulate a downward movement of the terminal accommodating member 22A.

Further, when the terminal accommodating member 22A is inserted, the pair of resilient pieces 44, 44 resiliently deformed by coming into contact with the terminal accommodating member 22A are restored through the retaining portions 28A, 29A and locked to the retaining portions 28A, 29A against a force of the terminal accommodating member 22A in an upward direction (detaching direction), whereby an upward movement of the terminal accommodating member 22A is regulated.

In this way, the terminal accommodating member 22A is vertically positioned (in the range of the clearances).

Subsequently, the terminal accommodating member 22B is guided in the inserting direction by inserting the first guide protrusion 34 and the second guide protrusion 36 into the first guide groove portion 35A provided on the terminal accommodating member 22A located in front and the second guide groove portion 51 provided in the holding member 41.

When the terminal accommodating member 22B is inserted to the proper position into the holding member 41, the locking portion 33 is locked to the first placing portion 35 provided on the terminal accommodating member 22A located in front and the pair of supporting portions 38, 38 are locked to the second placing portions 46, 46 to regulate a downward movement of the terminal accommodating member 22B.

Further, when the terminal accommodating member 22B is inserted, the pair of resilient pieces 44, 44 resiliently deformed by coming into contact with the terminal accommodating member 22B are restored through the retaining portions 28A, 29A and locked to the retaining portions 28A, 29A against a force of the terminal accommodating member 22B in an upward direction (detaching direction), whereby an upward movement of the terminal accommodating member B is regulated.

In this way, the terminal accommodating member 22B is vertically positioned (in the range of the clearances).

The terminal accommodating members 22C, 22D are also successively assembled into the holding member 41 similarly to the terminal accommodating member 22B.

When all the terminal accommodating members 22A to 22D are assembled into the holding member 41, the connector 20 is formed.

Figure 19:
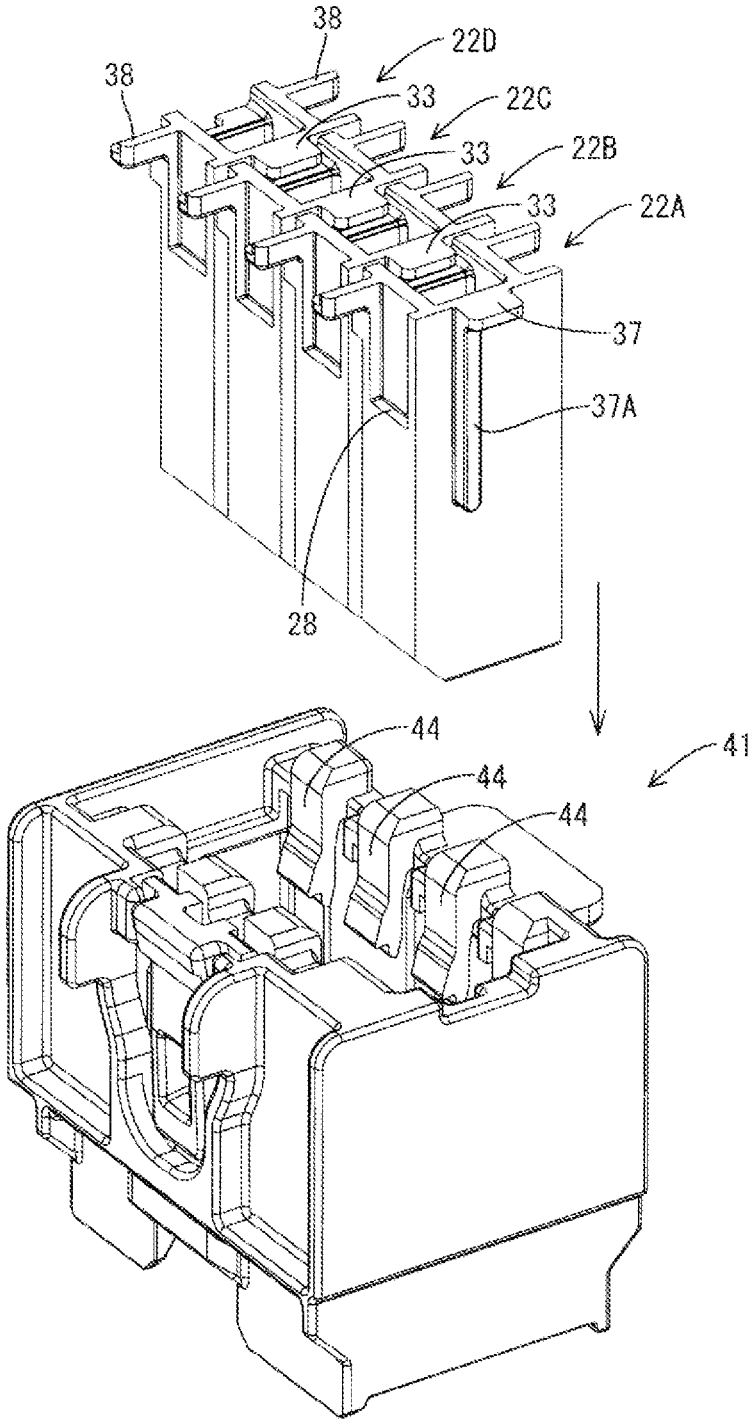
FIG. 19 is a perspective view showing the assembling of a plurality of terminal accommodating members into the holding member.

Note that, without limitation to the configuration for successively assembling the terminal accommodating members 22A to 22D, a group of the terminal accommodating members 22A to 22D may be inserted into the holding member 41 together as shown in FIG. 19.

When this connector 20 is connected to the device-side connector 10A, each terminal accommodating member 22A to 22D is displaced according to the clearances of the holding member locking portion 37 or the locking portion 33 and the pair of supporting portions 38, 38 to connect the two connectors 10A, 20 if the device-side connector 10A is displaced due to the dimensional tolerance.

According to this embodiment, the following functions and effects are exhibited.

The connector 20 of this embodiment is provided with the plurality of terminals 21 to be connected to the end parts of the wires W, the plurality of terminal accommodating members 22A to 22D configured to accommodate the plurality of terminals 21, and the holding member 41 including the pair of side wall portions 42, 43 facing each other and the pair of coupling wall portions 47, 47 connecting the end sides of the pair of side wall portions 42, 43 in the front-back direction (extending direction) and configured to hold the plurality of terminal accommodating members 22A to 22D side by side in the front-back direction (extending direction of the side wall portions 42, 43) between the pair of side wall portions 42, 43, and each terminal accommodating member 22A to 22D includes the pair of supporting portions 38, 38 projecting toward the respective side wall portions 42, 43 and supported on the respective side wall portions 42, 43.

With this arrangement, the terminal accommodating member 22A to 22D is supported on the respective side wall portions 42, 43 via the pair of supporting portions 38, 38. Thus, the holding member 41 can hold the terminal accommodating member 22A to 22D via the pair of supporting portions 38, 38 even without partitioning the holding member 41 by the walls of the accommodation chambers. Therefore, the configuration of the connector 20 can be simplified.

Further, since the terminal accommodating member 22A to 22D is held by supporting the pair of supporting portions 38, 38 on the side wall portions 42, 43 even if this arrangement is adopted, displacements of the pair of supporting portions 38, 38 can be easily allowed according to a tolerance when the connector 20 is connected to the device-side connector 10A (mating connector).

Further, the pair of supporting portions 38, 38 coaxially project.

With this arrangement, the displacement of the terminal accommodating member 22A to 22D during the connection to the device-side connector 10A is enabled by the rotation of the terminal accommodating member 22A to 22D about the axes of the supporting portions 38, 38.

Further, the terminal accommodating member 22A to 22D is assembled by being inserted between the pair of side wall portions 42, 43 and the pair of supporting portions 38, 38 are arranged on a rear end side of the terminal accommodating member 22A to 22D in the inserting direction.

With this arrangement, the configuration for supporting the pair of supporting portions 38, 38 on the pair of side wall portions 42, 43 can be simplified.

Furthermore, the device-side connector 10A (mating connector) is configured by stacking the plurality of split connector portions 13, the split connector portion 13 includes the male terminal 14 (mating terminal) to be connected to the terminal 21 and the partition wall 15 partitioning the male terminal 14 from the outside, the partition wall 15 of one split connector portion 13 out of the plurality of split connector portions 13 is formed into a rectangular tube surrounding the male terminal 14 on four sides, the partition walls 15 of the other split connector portions are formed into an U shape with one open side to surround the male terminal 14 on three sides, and the device-side connector 10A is configured by stacking the plurality of split connector portions 13 such that the open one side of the partition wall 15 of the split connector portion 13 is covered by the partition wall 15 of the adjacent split connector portion 13.

With this arrangement, the device-side connector 10A can be miniaturized by reducing the partition walls 15 for insulating the male terminals 14 from the outside for the device-side connector 10A configured by stacking the plurality of split connector portions 13. Thus, the connector 20 to be connected to the device-side connector 10A can also be miniaturized.

Further, the terminal accommodating member 22A to 22D is assembled by being inserted between the pair of side wall portions 42, 43 and includes the first guide protrusion 34 (guide portion) and the second guide protrusion 36 (guide portion) for guiding the terminal accommodating member 22A to 22D in the inserting direction by being engaged with the other terminal accommodating member 22A to 22D adjacent in the front-back direction (arrangement direction of the terminal accommodating members 22A to 22D) and (at least one of) the pair of side wall portions 42, 43.

With this arrangement, the insertion of the terminal accommodating member 22A to 22D into the holding member 41 can be facilitated.

Furthermore, each of the plurality of terminal accommodating members 22A to 22D includes the locking portion 33 to be locked to the other terminal accommodating member 22A to 22D adjacent in the front-back direction (arrangement direction of the terminal accommodating members 22A to 22D).

With this arrangement, the adjacent terminal accommodating members 22A to 22D can be held in position utilizing the configurations of the terminal accommodating members 22A to 22D.

Further, since the terminal accommodating member 22A to 22D is locked by the locking portion 33 in a direction different from the pair of supporting portions 38, 38, it can be held in a stable posture.

Furthermore, the device-side connector 10A (mating connector) is provided on the device unit 10 configured by stacking the plurality of flat devices 11A to 11D.

For the connector 20 to be connected to the device-side connector 10A in which a tolerance is easily generated between the male terminals 14 since the plurality of flat devices 11A to 11*d* are stacked, the tolerance of the device-side connector 10A can be absorbed by providing the terminal accommodating members 22A to 22D separately from the holding member 41. Since the terminal accommodating member 22A to 22D is supported on the respective side wall portions 42, 43 via the pair of supporting portions 38, 38 in such a configuration capable of absorbing the tolerance, the configuration of the connector 20 can be simplified.

Further, since the terminal accommodating member 22A to 22D has only to be processed into such a shape that the locking portion 33 and the pair of supporting portions 38, 38 project outwardly of the terminal accommodating member 22A to 22D, the manufacturing cost of a mold can be reduced.

The present invention is not limited to the above described and illustrated embodiment. For example, the following embodiments are also included in the technical scope of the present invention.

Although all the terminal accommodating members 22A to 22D are identically shaped in the above embodiment, the plurality of terminal accommodating members 22A to 22D may be differently shaped.

Further, it is not necessary to provide the locking portion 33 and the supporting portions 38 for all the terminal accommodating members 22B to 22D and the locking portion 33 and the supporting portions 38 may be provided on one or more of the terminal accommodating members 22B to 22D.

The number of the devices constituting the device unit 10 is not limited to four as in the above embodiment and may be another number. Further, the number of the terminal accommodating members is not limited to four as in the above embodiment and may be another number.

Although the pair of supporting portions 38, 38 coaxially project, they may not be coaxial.

Although the pair of supporting portions 38, 38 are arranged on the rear end side of the terminal accommodating member 22A to 22D in the inserting direction, there is no limitation to this. For example, a pair of supporting portions may be provided before the rear end part in the inserting direction and placing portions, on which these supporting portions are to be placed, may be provided on parts of the pair of side wall portions 42, 43 other than the upper end parts.

LIST OF REFERENCE SIGNS

10 . . . device unit
10A . . . device-side connector (mating connector)
11A to 11D . . . device
14 . . . male terminal
20 . . . connector
21 . . . terminal
22A to 22D . . . terminal accommodating member
23 . . . tubular portion
24 . . . front wall
25 . . . rear wall
26, 27 . . . side wall
32 . . . holding portion
33 . . . locking portion
34 . . . first guide protrusion (guide portion)
35 . . . first placing portion
35A . . . first guide groove portion
36 . . . second guide protrusion (guide portion)
37 . . . holding member locking portion
37A . . . end-part guide protrusion
38, 38 . . . pair of supporting portions
41 . . . holding member
42, 43 . . . side wall portion
44 . . . resilient piece
46 . . . second placing portion
48 . . . accommodating member placing portion
49 . . . end-part guide groove portion
51 . . . second guide groove portion
W . . . wire

The invention claimed is:

1. A connector to be connected to a mating connector provided on a device side, comprising:

a plurality of terminals to be connected to end parts of wires;

a plurality of terminal accommodating members configured to accommodate the plurality of terminals; and a holding member including a pair of side wall portions facing each other and a pair of coupling wall portions connecting end sides of the pair of side wall portions in an extending direction and configured to hold the plurality of terminal accommodating members side by side in a direction along the extending direction of the side wall portions between the pair of side wall portions, wherein:

each terminal accommodating member including a pair of supporting portions projecting toward the respective side wall portions and supported on the respective side wall portions;

the mating connector is configured by stacking a plurality of split connector portions;

the split connector portion includes a mating terminal to be connected to the terminal and a partition wall partitioning the mating terminal from outside;

the partition wall of one of the plurality of split connector portions is formed into a rectangular tube surrounding the mating terminal on four sides and the partition walls of the other partition walls are formed into a U shape with one open side surrounding the mating terminal on three sides; and the mating connector is configured by stacking the plurality of split connector portions such that the one open side of the partition wall in the split connector portion is covered by the partition wall of the adjacent split connector portion.

2. A connector according to claim 1, wherein:

the terminal accommodating member is assembled by being inserted between the pair of side wall portions; and the pair of supporting portions are arranged on a rear end side of the terminal accommodating member in an inserting direction.

3. A connector according to claim 1, wherein the terminal accommodating member is assembled by being inserted between the pair of side wall portions and includes a guide portion for guiding the terminal accommodating member in the inserting direction by being engaged with the other terminal accommodating member adjacently located in an arrangement direction of the terminal accommodating members and at least one of the pair of side wall portions.

4. A connector according to claim 1, wherein each of the plurality of terminal accommodating members includes a locking portion configured to lock the other terminal accommodating member adjacently located in an arrangement direction of the terminal accommodating members.

5. A connector according to claim 1, wherein the mating connector is provided on a device unit configured by stacking a plurality of flat devices.

6. A connector according to claim 1, wherein the pair of supporting portions coaxially project.

7. A connector according to claim 6, wherein:

the terminal accommodating member is assembled by being inserted between the pair of side wall portions; and the pair of supporting portions are arranged on a rear end side of the terminal accommodating member in an inserting direction.

8. A connector according to claim 7, wherein the terminal accommodating member is assembled by being inserted between the pair of side wall portions and includes a guide portion for guiding the terminal accommodating member in the inserting direction by being engaged with the other terminal accommodating member adjacently located in an arrangement direction of the terminal accommodating members and at least one of the pair of side wall portions.

9. A connector according to claim 8, wherein each of the plurality of terminal accommodating members includes a locking portion configured to lock the other terminal accommodating member adjacently located in an arrangement direction of the terminal accommodating members.

10. A connector according to claim 9, wherein the mating connector is provided on a device unit configured by stacking a plurality of flat devices.

* * * * *